US005702056A

United States Patent [19]

Yang

[11] Patent Number: 5,702,056

[45] Date of Patent: Dec. 30, 1997

[54] SPRINKLER

[76] Inventor: Ho-M Yang, No. 46, Lane 73, Sec. 2, Chang Nan Road, Chang Hua City, Taiwan

[21] Appl. No.: 678,645

[22] Filed: Jul. 11, 1996

[51] Int. Cl.[6] ..... B05B 3/00; B05B 15/10; B05B 1/28

[52] U.S. Cl. ..... 239/206; 239/288.5

[58] Field of Search ..... 239/200, 201, 239/203, 204, 206, 225.1, 261, 264, 288, 288.3, 288.5, 251

[56] References Cited

U.S. PATENT DOCUMENTS

| | | | |
|---|---|---|---|
| 1,058,549 | 4/1913 | Cathcart | 239/204 |
| 1,259,902 | 3/1918 | Parker | 239/204 |
| 2,513,047 | 6/1950 | Pfeiffer | 239/204 |
| 3,104,822 | 9/1963 | Muschett | 239/206 |
| 5,005,767 | 4/1991 | Heren | 239/288 |

FOREIGN PATENT DOCUMENTS

| | | | |
|---|---|---|---|
| 1382447 | 3/1988 | U.S.S.R. | 239/204 |

*Primary Examiner*—Andres Kashnikow
*Assistant Examiner*—Robin O. Evans
*Attorney, Agent, or Firm*—Beveridge, DeGrandi, Weilacher & Young LLP

[57] ABSTRACT

A sprinkler comprises a hollow box, a first casing and a second casing covering the hollow box, a telescopic pipe disposed in the hollow box longitudinally, and a sprinkling disk disposed on the telescopic pipe. The telescopic pipe has an outer pipe, a first middle pipe in the outer pipe, a second middle pipe in the first middle pipe, and an inner pipe in the second middle pipe. The sprinkling disk has a lower disk and an upper disk.

1 Claim, 4 Drawing Sheets

SPRINKLER

BACKGROUND OF THE INVENTION

The present invention relates to a sprinkler. More particularly, the present invention relates to a sprinkler which can extend upward while sprinkling.

Most conventional sprinklers are very short. The short sprinklers cannot sprinkle a large area. The sprinklers are exposed to the dust and sand. Thus the dust and sand may block the sprinkling holes of the sprinklers.

SUMMARY OF THE INVENTION

An object of the present invention is to provide a sprinkler which can extend upward while sprinkling. Another object of the present invention is to provide a sprinkler which can be protected by two casings.

Accordingly, a sprinkler comprises a hollow box, a first casing and a second casing covering the hollow box, a telescopic pipe disposed in the hollow box longitudinally, and a sprinkling disk disposed on the telescopic pipe. The telescopic pipe has an outer pipe, a first middle pipe in the outer pipe, a second middle pipe in the first middle pipe, and an inner pipe in the second middle pipe. A circular hole is formed on a lower periphery of the hollow box. A generally round opening is formed on a top portion of the hollow box. Two camber rims abut the generally round opening. Four hollow tubes are disposed on a top periphery of the hollow box. A threaded hole is formed on a lower periphery of the outer pipe. A joint has a threaded end passing through the circular hole to be inserted in the threaded hole and a distal end to connect a water pipe. The first casing has two rods, a weighted plate, a protrusion and a first curved top. A lobe extends downward from an outer rim of the first casing. The second casing has two bars, a weighted block, a protuberance and a second curved top. A lug extends downward from an outer rim of the second casing. The sprinkling disk has a lower disk and an upper disk. A top knob is disposed on a top center of the upper disk. A hollow connection is disposed on the lower disk. A plurality of conduits communicate with the hollow connection. A plurality of recesses are formed on a rim of the lower disk. A plurality of grooves are formed on a rim of the upper disk to match the corresponding recesses to form a plurality of through holes to receive the corresponding conduits. A bolt fastens the lower disk on an upper end of the inner pipe. The rods and the bars are inserted in the corresponding hollow tubes. When a water enters the water pipe, the joint and the telescopic pipe, a water pressure will push the telescopic pipe to extend upward. Thus the outer pipe, the first middle pipe, the second middle pipe, and the inner pipe extend upward. The sprinkling disk will push the first casing and the second casing to open.

DETAILED DESCRIPTION OF THE INVENTION

Figure 1:
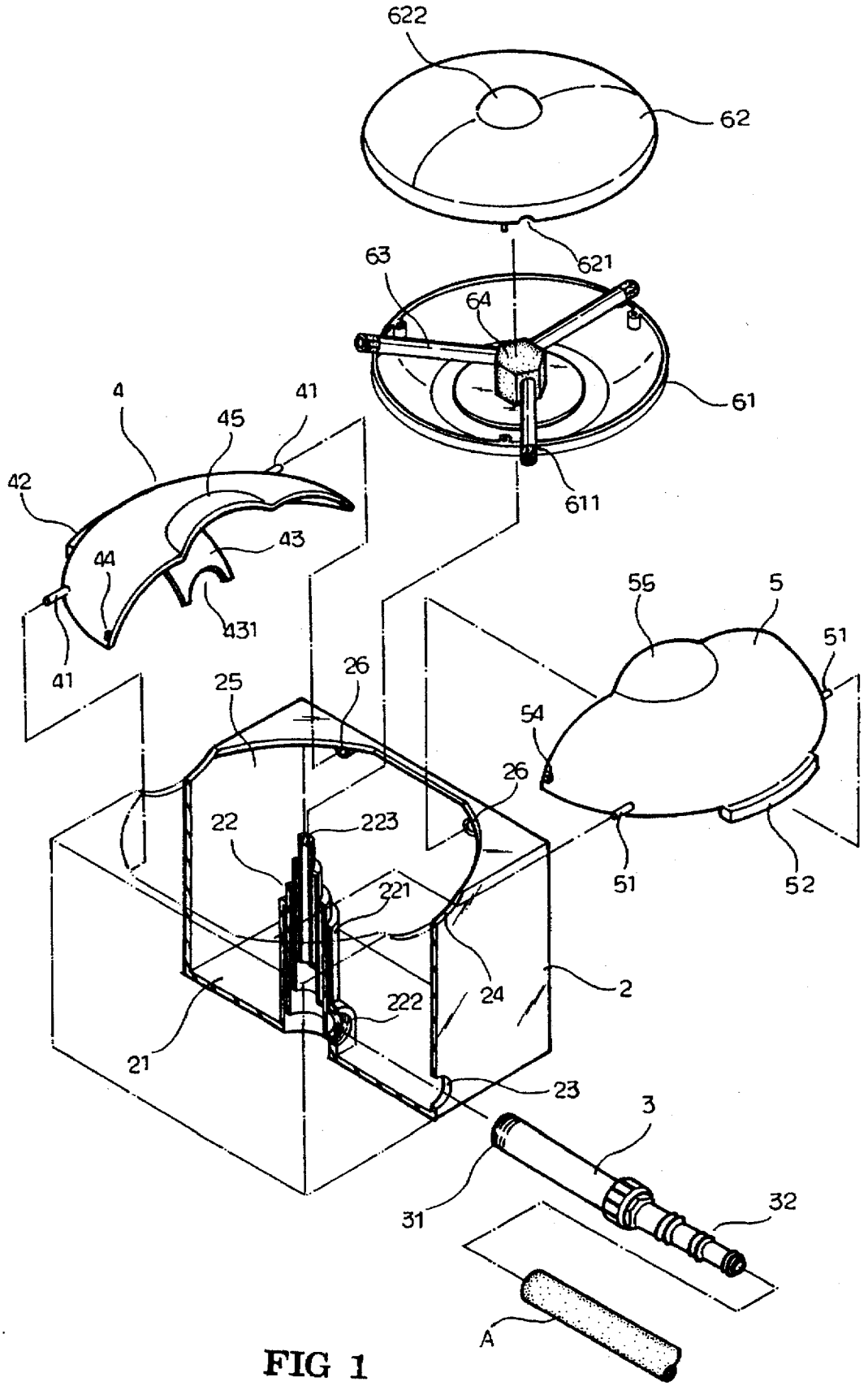
FIG. 1 is a perspective exploded view of a sprinkler of a preferred embodiment in accordance with the present invention.
Figure 5:
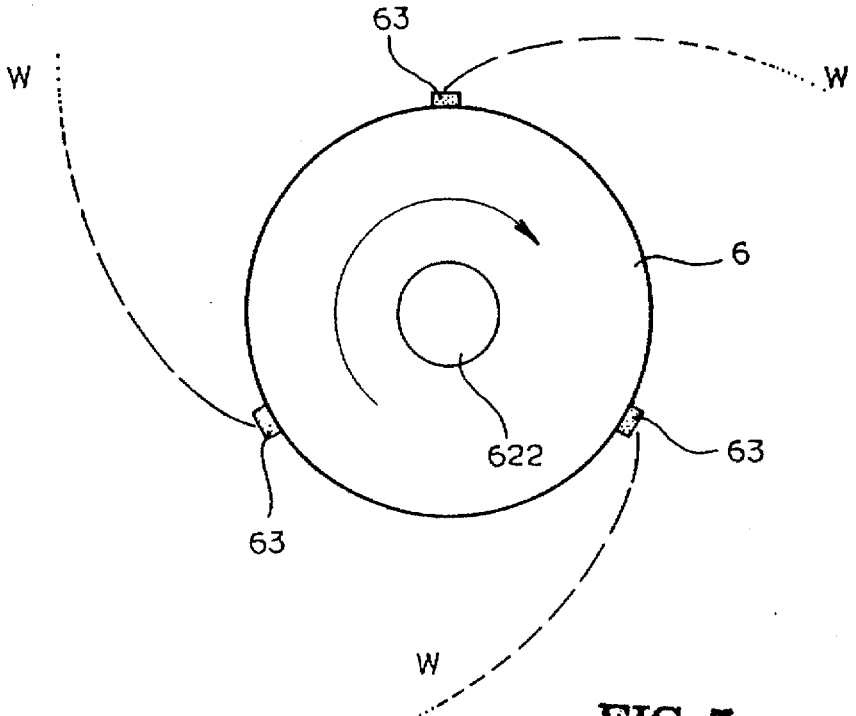
FIG. 5 is a top plan view of FIG. 4.
Figure 2:
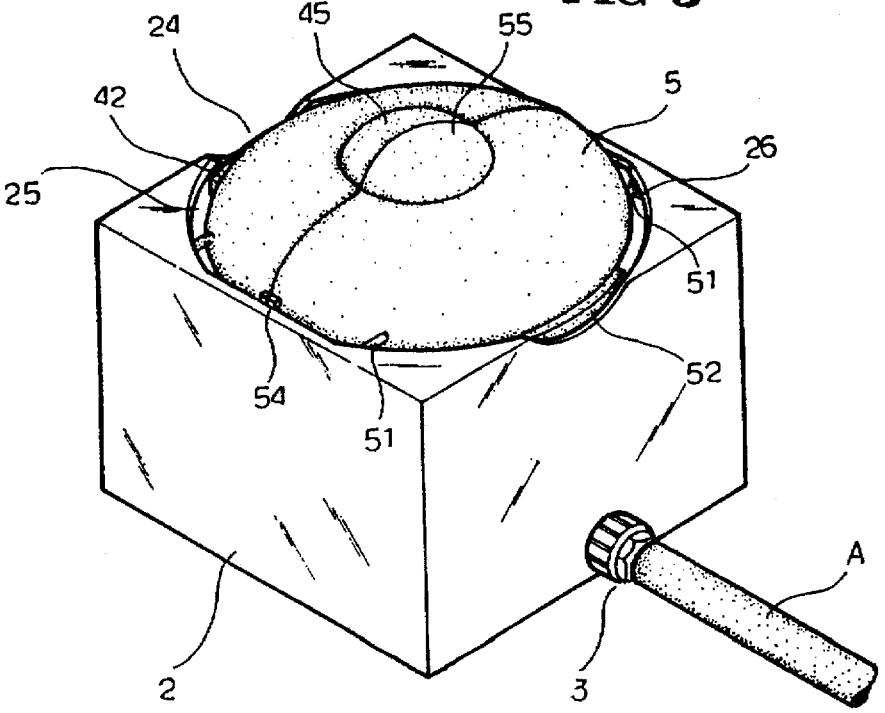
FIG. 2 is a perspective assembly view of FIG. 1.
Figure 3:
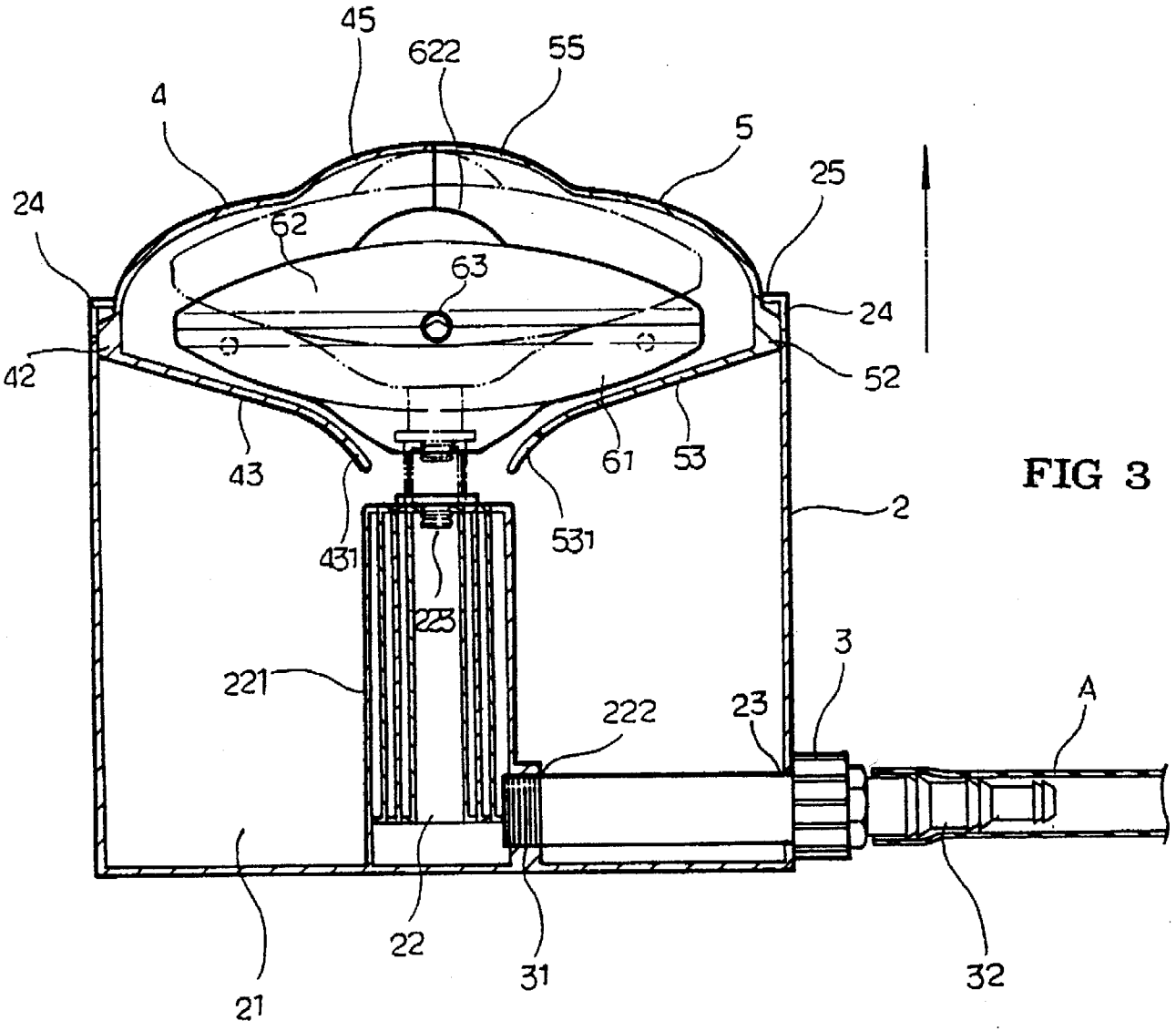
FIG. 3 is a sectional assembly view of FIG. 2.
Figure 4:
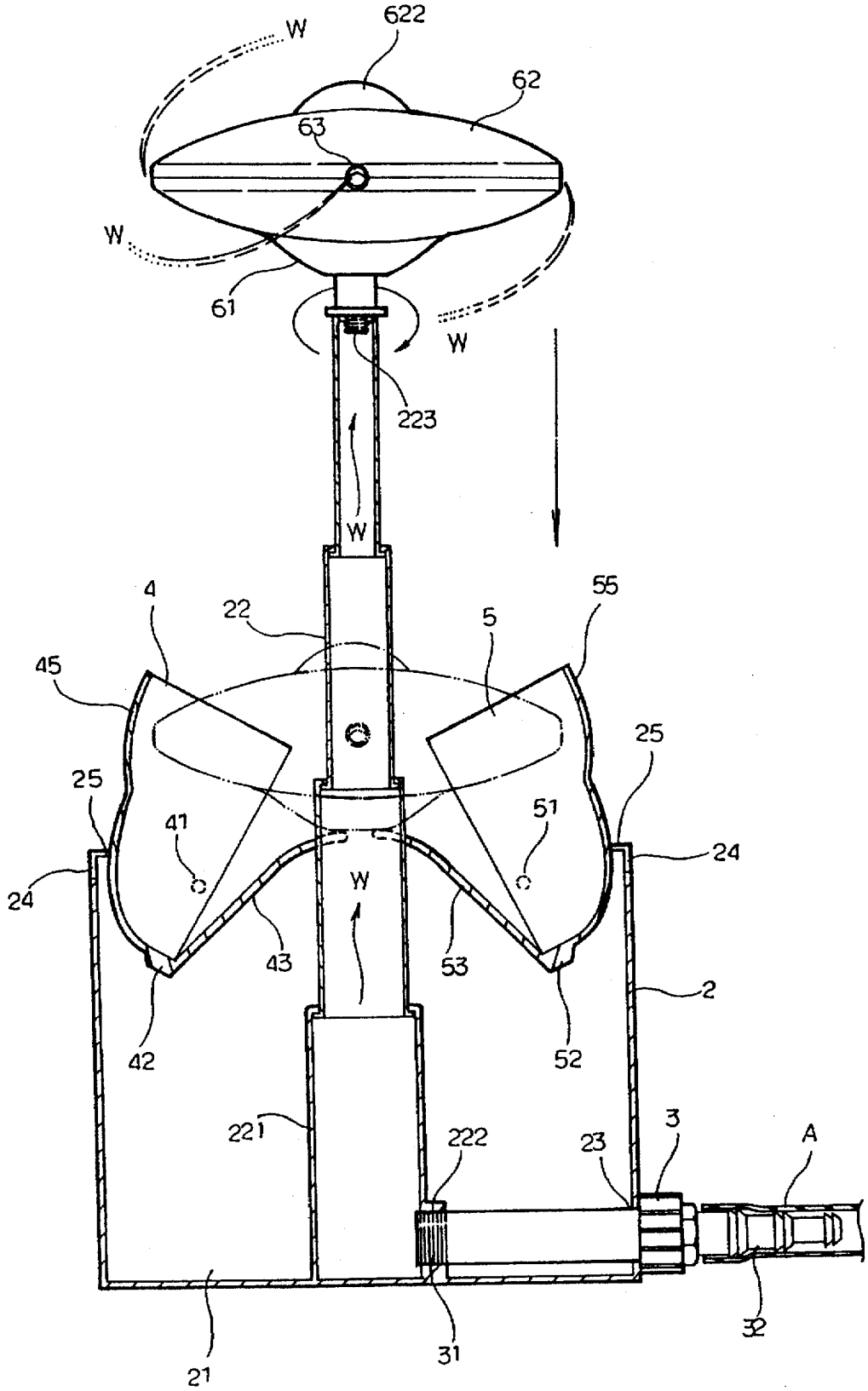
FIG. 4 is a schematic view of a sprinkler while the sprinkler is sprinkling.

Referring to FIGS. 1 to 5, a sprinkler comprises a hollow box 2, a first casing 4 and a second casing 5 covering the hollow box 2, a telescopic pipe 22 disposed in the hollow box 2 longitudinally, and a sprinkling disk 6 disposed on the telescopic pipe 22. The telescopic pipe 22 has an outer pipe 221, a first middle pipe 225 in the outer pipe 221, a second middle pipe 224 in the first middle pipe 225, and an inner pipe 220 in the second middle pipe 224. A circular hole 23 is formed on a lower periphery of the hollow box 2. A generally round opening 25 is formed on a top portion of the hollow box 2. Two camber rims 24 abut the generally round opening 25. Four hollow tubes 26 are disposed on a top periphery of the hollow box 2. A threaded hole 222 is formed on a lower periphery of the outer pipe 221. A joint 3 has a threaded end 31 passing through the circular hole 23 to be inserted in the threaded hole 222 and a distal end 32 to connect a water pipe A. The first casing 4 has two rods 41, a weighted plate 42, a protrusion 44 and a first curved top 45. A lobe 43 extends downward from an outer rim of the first casing 4. The second casing 5 has two bars 51, a weighted block 52, a protuberance 54 and a second curved top 55. A lug 53 extends downward from an outer rim of the second casing 5. The sprinkling disk 6 has a lower disk 61 and an upper disk 62. A top knob 622 is disposed on a top center of the upper disk 62. A hollow connection 64 is disposed on the lower disk 61. A plurality of conduits 63 communicate with the hollow connection 64. A plurality of recesses 611 are formed on a rim of the lower disk 61. A plurality of grooves 621 are formed on a rim of the upper disk 62 to match the corresponding recesses 611 to form a plurality of through holes to receive the corresponding conduits 63. A bolt 223 fastens the lower disk 61 on an upper end of the inner pipe 220. The rods 41 and the bars 51 are inserted in the corresponding hollow tubes 26.

When the water enters the water pipe A, the joint 3 and the telescopic pipe 22, a water pressure will push the telescopic pipe 22 to extend upward. Thus the outer pipe 221, the first middle pipe 225, the second middle pipe 224, and the inner pipe 220 extend upward. The sprinkling disk 6 will push the first casing 4 and the second casing 5 to open.

The invention is not limited to the above embodiment but various modification thereof may be made. Further, various changes in form and detail may be made without departing from the scope of the invention.

I claim:

1. A sprinkler comprises:

a hollow box, a first casing and a second casing covering said hollow box, a telescopic pipe disposed in said hollow box longitudinally, and a sprinkling disk disposed on said telescopic pipe, said telescopic pipe having at least an outer pipe, a middle pipe in said outer pipe, and an inner pipe in said middle pipe, a circular hole formed on a lower periphery of said hollow box, a generally round opening formed on a top portion of said hollow box, four hollow tubes disposed on a top periphery of said hollow box, a threaded hole formed on a lower periphery of said outer pipe, a joint having a threaded end passing through said circular hole to be inserted in said threaded hole and a distal end to connect a water pipe, said first casing having two rods, a weighted plate, a protrusion and a first curved top, a lobe extending downward from an outer rim of said first casing, said second casing having two bars, a weighted block, a protuberance and a second curved top, a lug extending downward from an outer rim of said second casing, said sprinkling disk having a lower disk and an upper disk, a hollow connection disposed on said lower disk, a plurality of conduits communicating with said hollow connection, a plurality of recesses formed on a rim of said lower disk, a plurality of grooves formed on a rim of said upper disk to match said corresponding recesses to form a plurality of through holes to receive said corresponding conduits, a bolt fastening said lower disk on an upper end of said inner pipe, said rods and said bars inserted in said corresponding hollow tubes, and wherein a water enters said water pipe, said joint and said telescopic pipe to push said telescopic pipe to extend upward.

* * * * *